US007434632B2

(12) United States Patent
Chen et al.

(10) Patent No.: US 7,434,632 B2
(45) Date of Patent: Oct. 14, 2008

(54) ROLLER CONE DRILL BITS WITH ENHANCED DRILLING STABILITY AND EXTENDED LIFE OF ASSOCIATED BEARINGS AND SEALS

(75) Inventors: Shilin Chen, The Woodlands, TX (US); Ping C. Sui, The Woodlands, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 368 days.

(21) Appl. No.: 10/919,990

(22) Filed: Aug. 17, 2004

(65) Prior Publication Data

US 2005/0194191 A1 Sep. 8, 2005

Related U.S. Application Data

(60) Provisional application No. 60/549,339, filed on Mar. 2, 2004.

(51) Int. Cl.
*E21B 10/16* (2006.01)
*E21B 10/08* (2006.01)

(52) U.S. Cl. ..... 175/57; 175/341; 175/431; 76/108.2

(58) Field of Classification Search ..... 175/57, 175/341, 374, 431; 76/108.2
See application file for complete search history.

(56) References Cited

U.S. PATENT DOCUMENTS

| | | | | |
|---|---|---|---|---|
| 1,209,299 | A | 12/1916 | Hughes | |
| 1,263,802 | A | 4/1918 | Reed | |
| 1,394,769 | A | 10/1921 | Sorensen | |
| 1,847,981 | A | 3/1932 | Reed | |
| 2,038,386 | A | 4/1936 | Scott et al. | 255/71 |
| 2,117,679 | A | 5/1938 | Reed | 255/71 |
| 2,122,759 | A | 7/1938 | Scott | 255/71 |
| 2,132,498 | A | 10/1938 | Smith | 255/71 |
| 2,165,584 | A | 7/1939 | Smith et al. | 255/71 |
| 2,230,569 | A | 2/1941 | Howard et al. | 255/71 |
| 2,496,421 | A | 2/1950 | Stokes | 255/71 |
| 2,728,559 | A | 12/1955 | Boice et al. | 255/334 |
| 2,851,253 | A | 9/1958 | Boice | 255/347 |
| 4,056,153 | A | 11/1977 | Miglierini | 175/376 |
| 4,187,922 | A | 2/1980 | Phelps | 175/374 |
| 4,285,409 | A | 8/1981 | Allen | 175/336 |

(Continued)

FOREIGN PATENT DOCUMENTS

| | | |
|---|---|---|
| CN | 2082755 U | 8/1991 |

(Continued)

OTHER PUBLICATIONS

Patent Acts 1977: Error in Search Report, Application No. GB0516638.4, 2 pgs, May 24, 2006.

(Continued)

*Primary Examiner*—Shane Bomar
(74) *Attorney, Agent, or Firm*—Baker Botts L.L.P.

(57) ABSTRACT

Roller cone drill bits may be formed with cutting elements and cutting structures having cutting element profile angles selected to minimize cone wobble and improve life of associated bearings and seals. Normal force axes of the cutting elements may intersect with each other as a force center. Crest points of the cutting elements may be disposed on one or more circles extending from the associated force center.

33 Claims, 8 Drawing Sheets

U.S. PATENT DOCUMENTS

| | | | | |
|---|---|---|---|---|
| 4,334,586 | A | 6/1982 | Schumacher | 175/374 |
| 4,343,371 | A | 8/1982 | Baker, III et al. | 175/329 |
| 4,343,372 | A * | 8/1982 | Kinzer | 175/374 |
| 4,393,948 | A | 7/1983 | Fernandez | 175/374 |
| 4,408,671 | A | 10/1983 | Munson | 175/377 |
| 4,427,081 | A | 1/1984 | Crawford | 175/376 |
| 4,455,040 | A | 6/1984 | Shinn | 285/142 |
| 4,611,673 | A | 9/1986 | Childers et al. | 175/340 |
| 4,627,276 | A | 12/1986 | Burgess et al. | 73/151 |
| 4,657,093 | A | 4/1987 | Schumacher | 175/353 |
| 4,738,322 | A | 4/1988 | Hall et al. | 175/329 |
| 4,776,413 | A | 10/1988 | Forsberg | 175/410 |
| 4,804,051 | A | 2/1989 | Ho | 175/26 |
| 4,815,342 | A | 3/1989 | Brett et al. | 76/108 |
| 4,848,476 | A | 7/1989 | Deane et al. | 175/340 |
| 4,889,017 | A | 12/1989 | Fuller et al. | 76/108 A |
| 5,010,789 | A | 4/1991 | Brett et al. | 76/108.2 |
| 5,027,913 | A * | 7/1991 | Nguyen | 175/336 |
| 5,042,596 | A | 8/1991 | Brett et al. | 175/57 |
| 5,131,478 | A | 7/1992 | Brett et al. | 175/57 |
| 5,131,480 | A | 7/1992 | Lockstedt et al. | 175/374 |
| 5,137,097 | A | 8/1992 | Fernandez | 175/228 |
| 5,197,555 | A | 3/1993 | Estes | 175/374 |
| 5,216,917 | A | 6/1993 | Detournay | 73/151 |
| 5,224,560 | A | 7/1993 | Fernandez | 175/374 |
| RE34,435 | E | 11/1993 | Warren et al. | 175/398 |
| 5,285,409 | A | 2/1994 | Hwangbo et al. | 365/189.12 |
| 5,291,807 | A | 3/1994 | Vanderford et al. | 76/108.2 |
| 5,305,836 | A | 4/1994 | Holbrook et al. | 175/39 |
| 5,311,958 | A | 5/1994 | Isbell et al. | 175/341 |
| 5,318,136 | A | 6/1994 | Rowsell et al. | 175/24 |
| 5,341,890 | A | 8/1994 | Cowthorne et al. | 175/374 |
| 5,351,770 | A | 10/1994 | Cawthorne et al. | 175/374 |
| 5,370,234 | A | 12/1994 | Sommer, Jr. et al. | 209/44.1 |
| 5,372,210 | A | 12/1994 | Harrell | 175/431 |
| 5,394,952 | A | 3/1995 | Johns et al. | 175/332 |
| 5,415,030 | A | 5/1995 | Jogi et al. | 73/151 |
| 5,416,697 | A | 5/1995 | Goodman | 364/422 |
| 5,421,423 | A | 6/1995 | Huffstutler | 175/374 |
| 5,456,141 | A | 10/1995 | Ho | 76/108.2 |
| 5,513,711 | A | 5/1996 | Williams | 175/57 |
| 5,579,856 | A | 12/1996 | Bird | 175/375 |
| 5,595,252 | A | 1/1997 | O'Hanlon | 175/57 |
| 5,595,255 | A | 1/1997 | Huffstutler | 175/331 |
| 5,605,198 | A | 2/1997 | Tibbitts et al. | 175/432 |
| 5,636,700 | A | 6/1997 | Shamburger, Jr. | 175/331 |
| 5,697,994 | A | 12/1997 | Packer et al. | 51/309 |
| 5,704,436 | A | 1/1998 | Smith et al. | 175/27 |
| 5,715,899 | A | 2/1998 | Liang et al. | 175/374 |
| 5,730,234 | A | 3/1998 | Putot | 175/50 |
| 5,767,399 | A | 6/1998 | Smith et al. | 73/152.11 |
| 5,794,720 | A | 8/1998 | Smith et al. | 175/40 |
| 5,812,068 | A | 9/1998 | Wisler et al. | 340/855.5 |
| 5,813,480 | A | 9/1998 | Zaleski, Jr. et al. | 175/40 |
| 5,813,485 | A | 9/1998 | Portwood | 175/430 |
| 5,839,526 | A | 11/1998 | Cisneros et al. | 175/431 |
| 5,853,245 | A | 12/1998 | Price | 384/96 |
| 5,967,245 | A | 10/1999 | Garcia et al. | 175/374 |
| 6,002,985 | A | 12/1999 | Stephenson | 702/13 |
| 6,003,623 | A | 12/1999 | Meiss | 175/430 |
| 6,012,015 | A | 1/2000 | Tubel | 702/6 |
| 6,021,377 | A | 2/2000 | Dubinsky et al. | 702/9 |
| 6,029,759 | A | 2/2000 | Sue et al. | 175/374 |
| 6,044,325 | A | 3/2000 | Chakravarthy et al. | 702/7 |
| 6,057,784 | A | 5/2000 | Schaaf et al. | 340/854.4 |
| 6,095,262 | A | 8/2000 | Chen | 175/57 |
| 6,095,264 | A * | 8/2000 | Dillard | 175/331 |
| 6,109,368 | A | 8/2000 | Goldman et al. | 175/39 |
| 6,119,797 | A * | 9/2000 | Hong et al. | 175/336 |
| 6,142,247 | A | 11/2000 | Pessier | 175/340 |
| 6,176,329 | B1 * | 1/2001 | Portwood et al. | 175/341 |
| 6,213,225 | B1 | 4/2001 | Chen | 175/57 |
| 6,241,034 | B1 | 6/2001 | Steinke et al. | 175/331 |
| 6,260,635 | B1 | 7/2001 | Crawford | 175/371 |
| 6,269,892 | B1 | 8/2001 | Boulton et al. | 175/61 |
| 6,308,790 | B1 | 10/2001 | Mensa-Wilmot et al. | 175/73 |
| 6,348,110 | B1 | 2/2002 | Evans | 148/528 |
| 6,349,595 | B1 | 2/2002 | Civolani et al. | 73/152.02 |
| 6,374,930 | B1 | 4/2002 | Singh et al. | 175/374 |
| 6,401,839 | B1 | 6/2002 | Chen | 175/57 |
| 6,412,577 | B1 | 7/2002 | Chen | 175/57 |
| 6,499,547 | B2 | 12/2002 | Scott et al. | 175/374 |
| 6,516,293 | B1 | 2/2003 | Huang et al. | 703/10 |
| 6,527,068 | B1 | 3/2003 | Singh et al. | 175/431 |
| 6,533,051 | B1 | 3/2003 | Singh et al. | 175/371 |
| 6,581,699 | B1 | 6/2003 | Chen et al. | 175/61 |
| 6,607,047 | B1 | 8/2003 | Swadi et al. | 175/374 |
| 6,619,411 | B2 | 9/2003 | Singh et al. | 175/57 |
| 6,729,420 | B2 | 5/2004 | Mensa-Wilmot | 175/385 |
| 6,848,518 | B2 | 2/2005 | Chen et al. | 175/61 |
| 6,856,949 | B2 | 2/2005 | Singh et al. | 703/7 |
| 6,879,947 | B1 | 4/2005 | Glass | 703/10 |
| 7,020,597 | B2 | 3/2006 | Oliver et al. | 703/7 |
| 7,079,996 | B2 | 7/2006 | Stewart et al. | 703/8 |
| 7,195,078 | B2 | 3/2007 | Singh et al. | 175/40 |
| 2001/0042642 | A1 | 11/2001 | King | 175/40 |
| 2003/0192721 | A1 | 10/2003 | Singh et al. | 175/341 |
| 2003/0195733 | A1 | 10/2003 | Huang et al. | 703/10 |
| 2004/0045742 | A1 | 3/2004 | Chen | 175/374 |
| 2004/0104053 | A1 | 6/2004 | Chen | 175/341 |
| 2004/0118609 | A1 | 6/2004 | Dennis | 175/57 |
| 2004/0167762 | A1 | 8/2004 | Chen | 703/10 |
| 2004/0251053 | A1 | 12/2004 | McDonough et al. | 175/378 |
| 2004/0254664 | A1 | 12/2004 | Centala et al. | 700/97 |
| 2005/0015230 | A1 | 1/2005 | Centala et al. | 703/10 |
| 2006/0032674 | A1 * | 2/2006 | Chen et al. | 175/372 |
| 2006/0074616 | A1 | 4/2006 | Chen | 703/10 |

FOREIGN PATENT DOCUMENTS

| | | | |
|---|---|---|---|
| EP | 0384734 | A1 | 8/1990 |
| EP | 0511547 | A2 | 4/1992 |
| EP | 0511547 | A3 | 4/1992 |
| EP | 0511547 | B1 | 4/1992 |
| EP | 1006256 | | 6/2000 |
| GB | 2186715 | | 8/1987 |
| GB | 2241266 | A | 8/1991 |
| GB | 2 300 208 | A | 10/1996 |
| GB | 2305195 | A | 4/1997 |
| GB | 2327962 | | 2/1999 |
| GB | 2363409 | A | 6/2001 |
| GB | 2365899 | A | 2/2002 |
| GB | 2367578 | A | 4/2002 |
| GB | 2367579 | A | 4/2002 |
| GB | 2367626 | | 4/2002 |
| GB | 2384567 | | 7/2003 |
| GB | 2388857 | | 11/2003 |
| GB | 2400696 | | 10/2004 |
| RU | 1768745 | A1 | 10/1992 |
| SU | 1654515 | A1 | 3/1988 |
| SU | 1691497 | A1 | 4/1988 |
| SU | 1441051 | A2 | 11/1988 |

OTHER PUBLICATIONS

Decision revoking European Patent No. EP-B-1117894, 16 pgs, May 15, 2006.

Notification of European Search Report for Patent application No. 04025232.5-2315, pages, Apr. 4, 2006.

Notification of European Search Report for Patent application No. 04025234.8-2315, 3 pages, Apr. 4, 2006.

Notification of European Search Report for Patent application No. 04025233.0-2315, 3 pages, Apr. 11, 2006.

Ma. D., et al. "*A New Method for Designing Rock Bit*", SPE Proceedings, vol. 22431, XP008058830, 10 pages, Mar. 24, 1992.

Notification of Great Britian Search Report for Application No. GB 0516638.4 (4 pages), Jan. 5, 2006.
Notification of Great Britain Search Report for Application No. GB 0523735.9 (3 pages), Jan. 31, 2006.
Communication from European Patent Office regarding opposition; Application No. 99945376.4-1266/1117894 through the Munich office (5 pages), Feb. 15, 2006.
Notification of European Search Report for Patent Application No. EP 04025560.6-2315 (4 pages), Feb. 24, 2006.
Notification of Eurpean Search Report for Patent Application No. EP 04025561.4-2315 (4 pages), Feb. 24, 2006.
Notification of European Search Report for Patent Application No. EP 04025562.2-2315 (4 pages), Feb. 24, 2006.
Notification of European Search Report for Patent Application No. EP 04025232.2-2315 (4 pages), Feb. 24, 2006.
W.C. Maurer, "The "Perfect-Cleaning" Theory of Rotary Drilling," Journal of Petroleum Technology, pp. 1175, 1270-1274, Nov. 1962.
International Search Report, PCT/US2006/030830, 11 pages, Mailing Date Dec. 19, 2006.
Menand et al., Classification of PDC Bits According to their Steerability, SPE, 11 pgs, 2003.
International Search Report, PCT/US2006/030803, 11 pgs, Mailing date Dec. 19, 2006.
Hare et al., Design Index: A Systematic Method of PDC Drill-Bit Seletion, SPE, 15 pgs, 2000.
Halliburton Revolutionizes PDC Drill Bit Design with the Release of FM3000, 2003 Press Releases, 2 pgs, Aug. 8, 2005.
D Stroud et al., "Development of the Industry's First Slimhole Point-the-Bit Rotary Steerable System," Society of Petroleum Engineers Inc, 4 pgs, 2003.
J.A. Norris, et al., "Development and Successful Application of Unique Steerable PDC Bits," Copyright 1998 IADC/SPE Drilling Conference, 14 pgs, Mar. 3, 1998.
O. Vincke, et al., "Interactive Drilling: The Up-To-Date Drilling Technology," Oil & Gas Science and Technology Rev. IFP, vol. 59, No. 4, pp. 343-356, Jul. 2004.
Halliburton catalogue item entitled: EZ-Pilot (TM) Rotary Steerable System (1 page), Jul. 24, 2006.
Halliburton catalogue item entitled: Geo-Pilot (R) Rotary Steerable System (1 page), Jul. 24, 2006.
Halliburton catalogue item entitled: SlickBore (R) Matched Drilling System (1 page), Jul. 24, 2006.
D. Ma, D. Zhou & R. Deng, *The Computer Stimulation of the Interaction Between Roller Bit and Rock*, (1995).
D. Ma, & J.J. Azar, *Dynamics of Roller Cone Bits*, Dec. 1985.
D.K.Ma & S.L. Yang, *Kinamatics of the Cone Bit*, Jun. 1985.
Dma & J.J. Azar, *A New Way to Characterize the Gouging-Scraping Action of Roller Cone Bits*, 1989.
Russian bit catalog listing items "III 190,5 T-LIB-1" and "III 109,5 TKZ-LIB", prior 1997.
L.E. Hibbs, Jr., et al, *Diamond Compact Cutter Studies for Geothermal Bit Design*, Nov. 1978.
M.C. Sheppard, et al., "*Forces at the Teeth of a Drilling Rollercone Bit: Theory and Experiment*", Proceedings: 1988 SPE Annual Technical Conference and Exhibition; Houston, TX, USA, Oct. 2-5, 1988, Vol. Delta, 1998, pp. 253-260 18042, XP002266080, Soc. Pet Eng AIME Pap SPE 1988 Publ by Soc of Petroleum Engineers of AIME, Richardson, TX, USA.
T.M. Warren et al, "*Drag-Bit Performance Modeling*", SPE Drill Eng. Jun. 1989, vol. 4, No. 2, pp. 119-127 15618, XP002266079, Jun. 1989.
"*Making Hole*", part of Rotary Drilling Series, edited by Charles Kirkley, 1983.
T.M. Warren,"*Factors Affecting Torque for A Roller Cone Bit*", JPT J PET Technol Sep. 1984, vol. 36, No. 10, pp. 1500-1508, XP002266078.
J.C. Estes, "*Selecting the Proper Rotary Rock Bit*", Journal of Petroleum Technology, pp. 1359-1367, Nov. 1971.
Sikarskie, et al., "*Penetration Problems in Rock Mechanics*", American Society of Mechanical Engineers, Rock Mechanics Symposium, 1973.
Dykstra, et. al., "*Experimental Evaluations of Drill String Dynamics*", Amoco Report No. SPE 28323, 1994.
Kenner and Isbell, "*Dynamic Analysis Reveals Stability of Roller Cone Rock Bits*", SPE 28314, 1994.
Brochure entitled "*Twist & Shout*", (SB2255.1001), 4 pages.
Drawing No. A46079 Rock Bit and Hole Opener; Security Engineering Co., Inc., Whittier, California, Sep. 14, 1946.
R.K. Dropek, "A Study to Determine Roller Cone Cutter Offset Effects at Various Drilling Depths" American Society of Mechanical Engineers. 10 pages, Aug. 1, 1979.
U.S. Appl. No. 10/325,650, filed Dec. 19, 2002 by John G. Dennis, entitled Drilling with Mixed Tooth Types.
British Search Report for GB Patent Application No. 0504304.7, 4 pgs, Apr. 22, 2005.
British Search Report for GB Patent Application No. 0503934.2, 3 pgs, May 16, 2005.
Energy Balanced Series Roller Cone Bits, www.halliburton.com/oil_gas/sd1380.jsp.
Ashmore, et al., Stratapax™ Computer Program, Sandia Laboratories, Albuquerque, NM , (76 pages).
F.A.S.T.™ Technology Brochure entitled "*Tech Bits*", Security/Dresser Industries (1 page), Sep. 17, 1993.
Sii PLUS Brochure entitled "*The PDC Plus Advantage*", from Smith International (2 pages).
Specification sheet entitled "*SQAIR Quality Sub-Specification*", Shell Internationale Petroleum Mij. B.V., The Hague, The Netherlands, 1991 (2 Pages), 1991.
Brochure entitled "*FM2000 Series-Tomorrow's Technologoies for Today's Drilling*.", Security DBS, Dresser Industries, Inc., 1994 ( Pages), 1994.
Brochure entitled "*FS2000 Series-New Steel Body Technology Advances PDC Bit Performance and Efficiency*", Security DBS, Dresser Industries, Inc. (6 pages), 1997.
Communication of a Notice of Opposition filed Oct. 14, 2004 with the European Patent Office, Mailed Oct. 21, 2004.
Brief Communication from European Patent Office enclosing letter from the opponent of Oct. 13, 2004.
Composite Catalog of Oil Filed Equipment & Services, 27th Revision 1666-67 vol. 3, 1966.
Lecture Handouts, *Rock Bit Design, Dull grading, Selection and Application*, presented by Reed Rock bit Company, Oct. 16, 1980.
*Longer Useful Lives for Roller Bits Cuts Sharply into Drilling Costs*, South African Mining & Engineering Journal, vol. 90, pp. 39-43, Mar. 19, 1979.
Brief Communication from European Patent Office enclosing letter from the opponent dated Dec. 2, 2004.
D.K. Ma, "A New Method of Desription of Scraping Characteristics of Roller cone Bit" Petoleum Machinery (in Chinese); Also attached is the English translation, "New Method for Characterizing the Scraping-Chiseling Performance of Rock Bits", Jul. 1988.
Steklyanov, B.L. et al.; "Improving the Effectiveness of Drilling Tools", Central Institute for Scientific and Technical Information and Technical and Economic Research on Chemical and Petroleum Machine Building, Series KhM-3, (in Russian) Moscow, 1991, 34 pages, also attached is English translation, 1991.
"Machino Export", Russia, 4 pages, 1974.
Approved Judgement, Case No. HC 04 C 00114 00689 00690, Royal Courts of Justice, BEtween: Halliburton Energy Services, Inc. and (1) Smith International (North Sea) Limited (2) Smith International, Inc. (3) Smith International Italia SpA, Jul. 21, 2005.
MA Dekum, *The Operational Mechanics of the Rock Bit*, Petroleum Industry Press, Beijing, China, 1996.
Shilin Chen, *Linear and Nonlinear Dynamics of Drillstrings*, 1994-1995.
Adam T. Bourgoyne Jr et al., "*Applied Drilling Engineering*", Society of Petroleum Engineers Textbook Series, 1991.
Plaintiff's Original Complaint for Patent Infringement and Jury Demand, filed Sep. 6, 2002 in the United States District Court for the Eastern District of Texas, Sherman Division, Civil Action No. 4-02CV269, *Halliburton Energy Services, Inc.* v. *Smith International, Inc.*, 4 pages.
Answer and Counterclaim of Smith International, filed Mar. 14, 2003, in the United States District Court for the Eastern District of Texas, Sherman Division, Civil Action No. 4-02CV269, *Halliburton Energy Services, Inc.* v. *Smith International, Inc.*, 6 pages.

Response of Plaintiff and Counterclaim Defendant to Defendant's Counterclaim of Declaratory Judgment, filed Apr. 3, 2003, in the United States District Court for the Eastern District of Texas, Sherman Division, Civil Action No. 4-02CV269, *Halliburton Energy Services, Inc.* v. *Smith International, Inc.*, 3 pages.

First Amended Answer and Counterclaim of Smith International, filed Oct. 9, 2003, in the United States District Court for the Eastern District of Texas, Sherman Division, Civil Action No. 4-02CV269, *Halliburton Energy Services, Inc.* v. *Smith International, Inc.*, 8 pages.

J. P. Nguyen, "*Oil and Gas Field Development Techniques: Drilling*" (translation 1996, from French original1993).

"*Drilling Mud*", part of Rotary Drilling Series, edited by Charles Kirkley, 1984.

H.G. Benson, "*Rock Bit Design, Selection and Evaluation*", presented at the spring meeting of the pacific coast district, American Petroleum Institute, Division of Production, Los Angeles, May 1956.

Memorandum Opinion fo Judge Davis, signed Feb. 13, 2004, in the United States of District Court for the Eastern District of Texas, Sherman Division, Civil Action No. 4-02CV269, *Halliburton Energy Services, Inc.* v. *Smith International, Inc.*, 37 pages (including fax coversheet).

Final Judgment of Judge Davis, signed Aug. 13, 2004, in the United States District Court for the Eastern District of Texas, Sherman Division, Civil Action No. 4-02CV269, *Halliburton Energy Services, Inc.* v. *Smith International, Inc.* , 3 pages.

Sworn written statement of Stephen Steinke and Exhibits SS-1 to SS-6, Oct. 13, 2004.

Wilson C. Chin, *Wave Propagation in Petroleum Engineering*, 1994.

Rabia, H., *Oilwell Driling Engineering: Principles and Practice*, University of Newcastle upon Tyne, 331 pages, 1985.

* cited by examiner

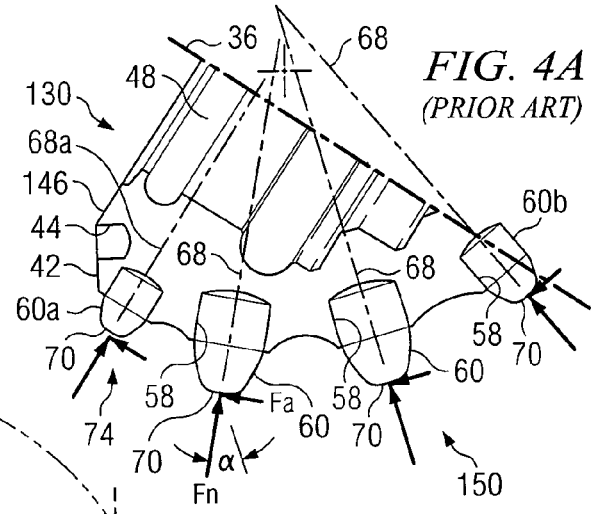
FIG. 4A
(PRIOR ART)
FIG. 4B
(PRIOR ART)
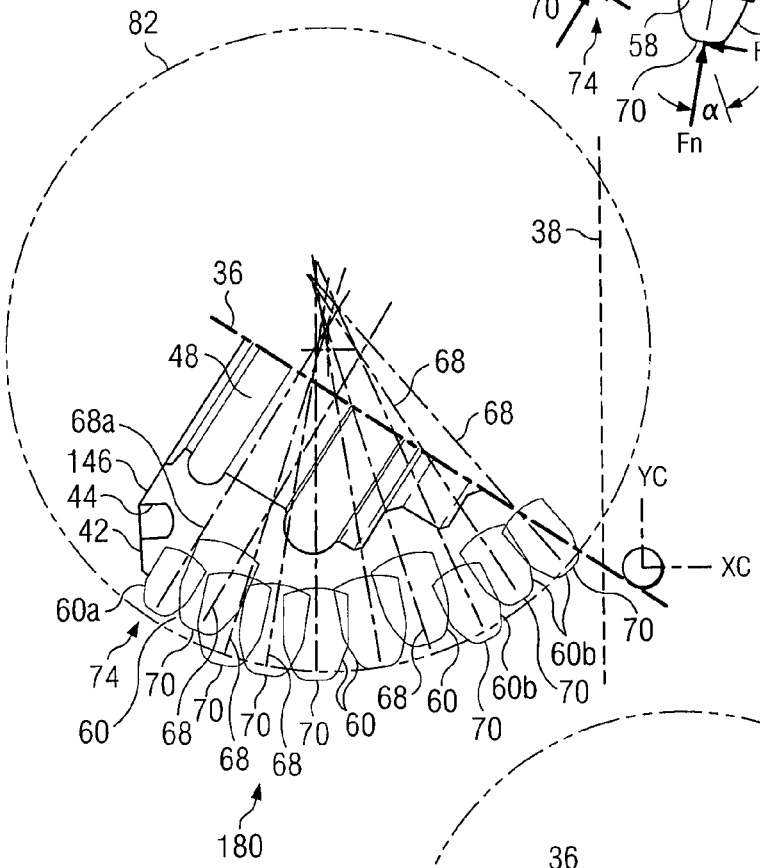
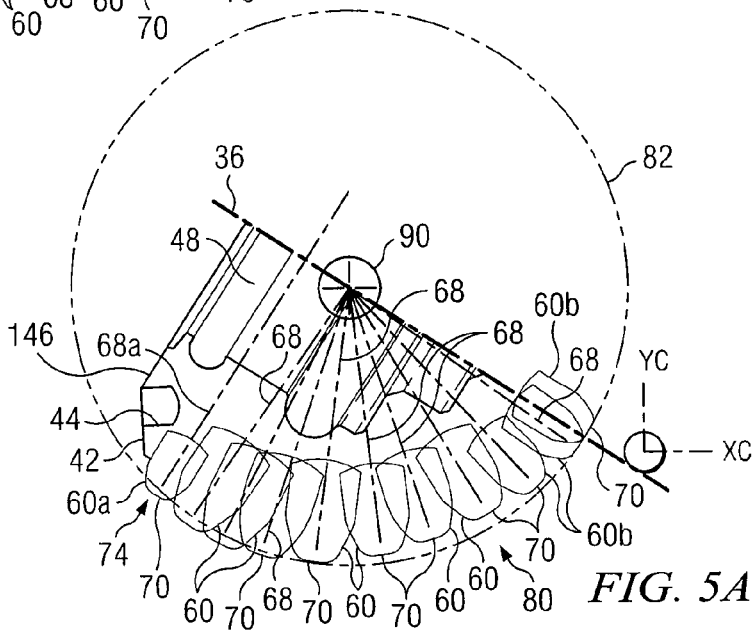
FIG. 5A

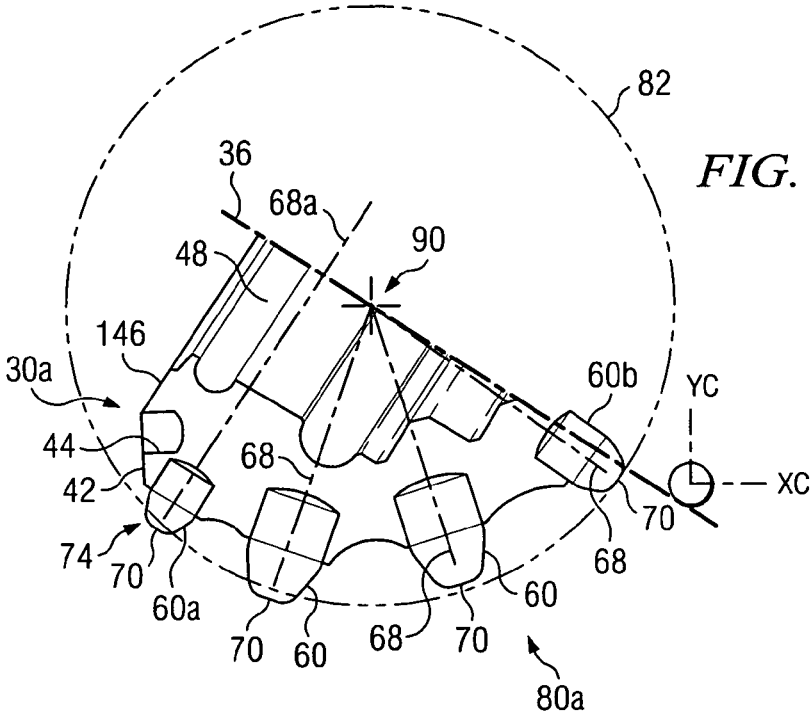
FIG. 5B
FIG. 5C
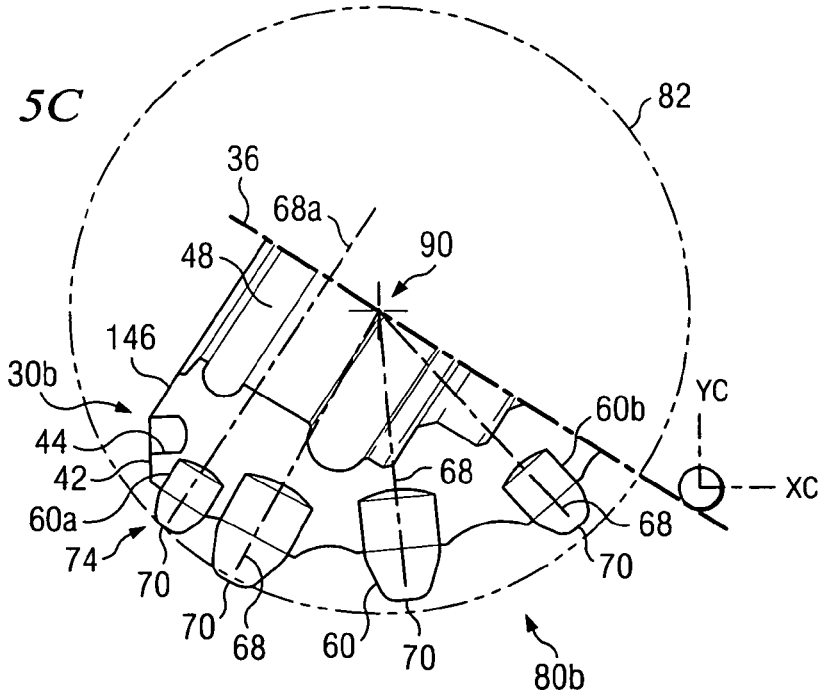

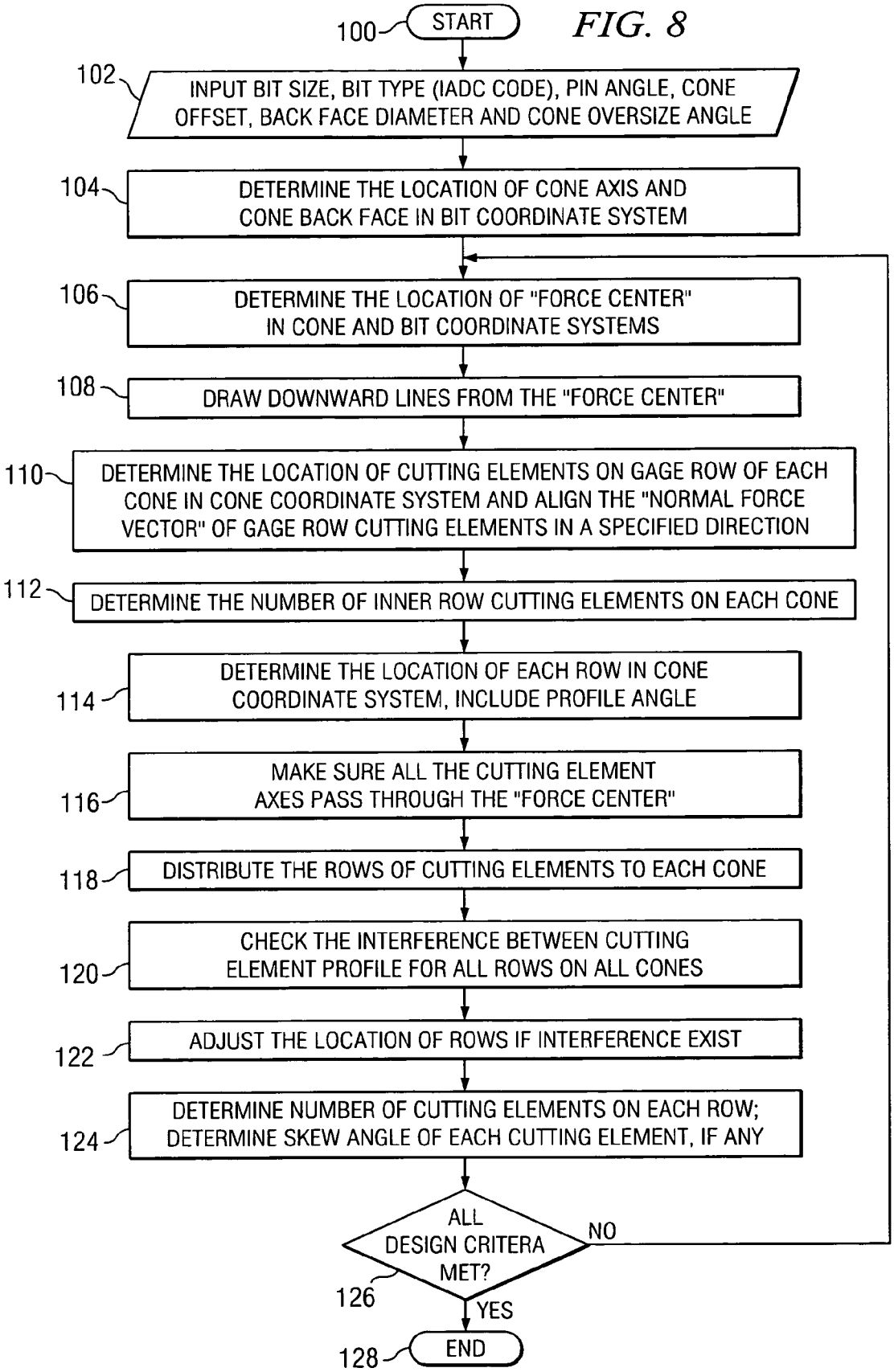
FIG. 8
100
START
102
INPUT BIT SIZE, BIT TYPE (IADC CODE), PIN ANGLE, CONE OFFSET, BACK FACE DIAMETER AND CONE OVERSIZE ANGLE
104
DETERMINE THE LOCATION OF CONE AXIS AND CONE BACK FACE IN BIT COORDINATE SYSTEM
106
DETERMINE THE LOCATION OF "FORCE CENTER" IN CONE AND BIT COORDINATE SYSTEMS
108
DRAW DOWNWARD LINES FROM THE "FORCE CENTER"
110
DETERMINE THE LOCATION OF CUTTING ELEMENTS ON GAGE ROW OF EACH CONE IN CONE COORDINATE SYSTEM AND ALIGN THE "NORMAL FORCE VECTOR" OF GAGE ROW CUTTING ELEMENTS IN A SPECIFIED DIRECTION
112
DETERMINE THE NUMBER OF INNER ROW CUTTING ELEMENTS ON EACH CONE
114
DETERMINE THE LOCATION OF EACH ROW IN CONE COORDINATE SYSTEM, INCLUDE PROFILE ANGLE
116
MAKE SURE ALL THE CUTTING ELEMENT AXES PASS THROUGH THE "FORCE CENTER"
118
DISTRIBUTE THE ROWS OF CUTTING ELEMENTS TO EACH CONE
120
CHECK THE INTERFERENCE BETWEEN CUTTING ELEMENT PROFILE FOR ALL ROWS ON ALL CONES
122
ADJUST THE LOCATION OF ROWS IF INTERFERENCE EXIST
124
DETERMINE NUMBER OF CUTTING ELEMENTS ON EACH ROW; DETERMINE SKEW ANGLE OF EACH CUTTING ELEMENT, IF ANY
ALL DESIGN CRITERA MET?
126
NO
YES
128
END

ROLLER CONE DRILL BITS WITH ENHANCED DRILLING STABILITY AND EXTENDED LIFE OF ASSOCIATED BEARINGS AND SEALS

RELATED APPLICATION

This application claims the benefit of previously filed provisional patent application Ser. No. 60/549,339 entitled Roller Cone Drill Bits With Enhanced Drilling Stability and Extended Life Of Associated Bearings And Seals filed date Mar. 2, 2004.

TECHNICAL FIELD

The present invention is related to roller cone drill bits used to form wellbores in subterranean formations and more particularly to arrangement and design of cutting elements and cutting structures to enhance drilling stability, extend life of associated bearings and seals and improve control during directional drilling.

BACKGROUND

A wide variety of roller cone drill bits have previously been used to form wellbores in downhole formations. Such drill bits may also be referred to as "rotary" cone drill bits. Roller cone drill bits frequently include a bit body with three support arms extending therefrom. A respective cone assembly is generally rotatably mounted on each support arm opposite from the bit body. Such drill bits may also be referred to as "rock bits".

Examples of roller cone drill bits satisfactory to form wellbores include roller cone drill bits with only one support arm and one cone, two support arms with a respective cone assembly rotatably mounted on each arm and four or more cones rotatably mounted on an associated bit body. Various types of cutting elements and cutting structures such as compacts, inserts, milled teeth and welded compacts have also been used in association with roller cone drill bits.

Cutting elements and cutting structures associated with roller cone drill bits typically form a wellbore in a subterranean formation by a combination of shearing and crushing adjacent portions of the formation. The shearing motion may also be described as each cutting element scraping portions of the formation during rotation of an associated cone. The crushing motion may also be described as each cutting element penetrating or gouging portions of the formation during rotation of an associated cone.

Roller cone drill bits having cutting structures formed by milling steel teeth are often used for drilling soft formations. Roller cone drill bits having cutting elements and cutting structures formed from a plurality of hard metal inserts or compacts are often used for drilling both medium and hard formations. Roller cone drill bits are generally more efficient in removing a given volume of formation by shearing or scraping as compared with crushing or penetration of the same formation. It is generally well known in the roller cone drill bit industry that drilling performance may be improved by varying the orientation of cutting elements and cutting structures disposed on associated cone assemblies.

SUMMARY OF THE DISCLOSURE

In accordance with teachings of the present disclosure, roller cone drill bits may be provided with cutting elements and cutting structures designed to substantially reduce or eliminate forces and moments which often produce cone wobble and reduce downhole drilling life of associated bearings and seals. Adjusting respective profile angles of cutting elements and orienting the axis of each cutting element to pass through a selected force center in accordance to teachings of the present invention may substantially reduce cone wobble associated with normal forces placed on each cutting element by contact with the formation. Selecting a location for the force center proximate the axis of rotation of each cone assembly will often minimize cone assembly wobble and increase the life of an associated roller cone drill bit, especially the life of associated seals and bearings.

Technical benefits of the present invention include arrangement of cone profiles and profile angles of cutting elements and cutting structures to enhance drilling stability of an associated roller cone drill bit. The enhanced drilling stability may be particularly beneficial for drilling soft and medium formation with hard stringers (sometimes referred to as "interbedded formations"). The present invention may provide improved directional control and steering ability of a roller cone drill bit during drilling of inclined and horizontal wellbores.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein:

FIG. 4A is a schematic drawing showing a cone profile for a cone assembly associated with a conventional roller cone drill bit;

FIG. 4B is a schematic drawing showing a composite cone profile for a conventional roller cone drill bit having three cone assemblies with multiple cutting elements disposed on each cone assembly;

FIG. 5A is a schematic drawing showing a composite cone profile for three cone assemblies of a roller cone drill bit having cutting elements and cutting structures incorporating teachings of the present invention;

FIG. 5B is a schematic drawing showing a cone profile for a first cone assembly associated with the composite cone profile of FIG. 5A;

FIG. 5C is a schematic drawing showing a cone profile for a second cone assembly associated with the composite cone profile of FIG. 5A;

FIG. 8 is a block diagram showing one example of procedures which may be used to design a roller cone drill bit with cutting elements and cutting structures in accordance with teachings of the present invention;

DETAILED DESCRIPTION OF THE DISCLOSURE

Figure 1:
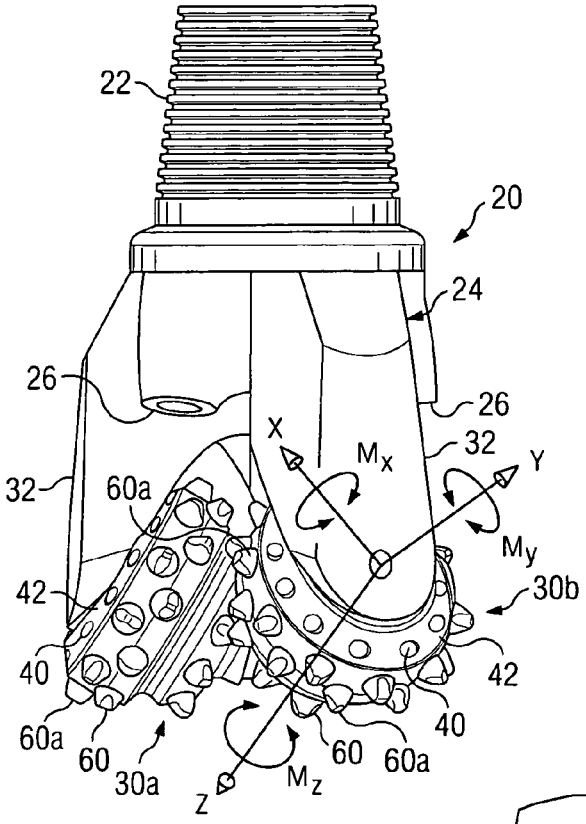
FIG. 1 is a schematic drawing showing an isometric view of a roller cone drill bit incorporating teachings of the present invention.

Preferred embodiments and their advantages are best understood by reference to FIGS. 1-10 wherein like numbers refer to same and like parts.

The terms "cutting element" and "cutting elements" may be used in this application to include various types of compacts, inserts, milled teeth and welded compacts satisfactory for use with roller cone drill bits. The terms "cutting structure" and "cutting structures" may be used in this application to include various combinations and arrangements of cutting elements formed on or attached to one or more cone assemblies of a roller cone drill bit.

The terms "crest" and "longitudinal crest" may be used in this application to describe portions of a cutting element or cutting structure that makes initial contact with a formation during drilling of a wellbore. The crest of a cutting element will typically engage and disengage the bottom of a wellbore during rotation of a roller cone drill bit and associated cone assembly. The geometric configuration and dimensions of crests may vary substantially depending upon specific design and dimensions of associated cutting elements and cutting structures.

Cutting elements generally include a "crest point" defined as the center of a "cutting zone" for each cutting element. The location of the cutting zone depends in part on the location of respective cutting element on an associated cone assembly. The size and configuration of each cutting element also determines the location of the associated cutting zone. Frequently, a cutting zone may be disposed adjacent to the crest of a cutting element. For some applications, cutting elements and cutting structures may be formed in accordance with teachings of the present invention with relatively small crests or dome shaped crests. Such cutting elements and cutting structures will typically have a crest point located proximate the center of the crest or dome. Cutting elements and cutting structures formed in accordance with teachings of the present invention may have various designs and configurations.

The term "cone profile" may be defined as an outline of the exterior surface of a cone assembly and all cutting elements associated with the cone assembly projected onto a plane passing through an associated cone rotational axis. In FIGS. 5A-7, various features of the present invention are shown with respect to a vertical plane passing through an associated cone rotational axis. Cone assemblies associated with roller cone drill bits typically have generally curved, tapered exterior surfaces. The physical size and shape of each cone profile depends upon various factors such as size of an associated drill bit, cone rotational angle, offset of each cone assembly and size, configuration and number of associated cutting elements.

Roller cone drill bits typically have "composite cone profiles" defined in part by each associated cone profile and the crests of all cutting elements projected onto a plane passing through a composite axis of rotation for all associated cone assemblies. Composite cone profiles for roller cone drill bits and each cone profile generally include the crest point for each associated cutting element.

Various types of cutting elements and cutting structures may be formed on a cone assembly. Each cutting element will typically have a normal force axis extending from the cone assembly. The term "cutting element profile angle" may be defined as an angle formed by a cutting element's normal force axis and associated cone rotational axis. For some roller cone drill bits the cutting element profile angle for cutting elements located in associated gauge rows may be approximately ninety degrees (90°). For example see FIGS. 4A, B, C and D.

Figure 10:
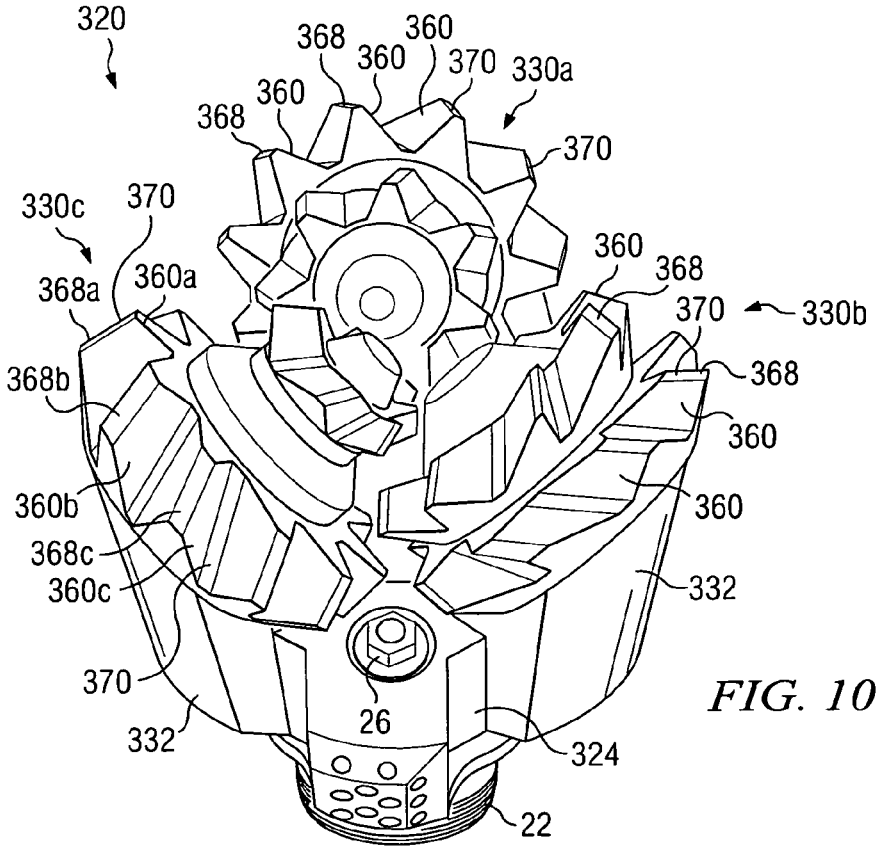
FIG. 10 is a schematic drawing showing an isometric view of a milled tooth drill bit having cutting elements and cutting structures formed in accordance with teachings of the present invention.

FIGS. 1 and 10 show examples of roller cone drill bits 20 and 320 having one or more cone assemblies with cutting elements and cutting structures incorporating teachings of the present invention. Roller cone drill bits 20 and 320 may be used to form a wellbore (not expressly shown) in a subterranean formation (not expressly shown). Roller cone drill bits 20 and 320 typically form wellbores by crushing or penetrating a formation and scraping or shearing formation materials from the bottom of the wellbore using cutting elements 60 and 360. The present invention may be used with roller cone drill bits having inserts and roller cone drill bits having milled teeth. The present invention may also be used with roller cone drill bits having cutting elements (not expressly shown) welded to associated cone assemblies.

A drill string (not expressly shown) may be attached to threaded portion of drill bit 20 or drill bit 320 to both rotate and apply weight or force to associated cone assemblies 30 and 330 as they roll around the bottom of a wellbore. For some applications various types of downhole motors (not expressly shown) may also be used to rotate a roller cone drill bit incorporating teachings of the present invention. The present invention is not limited to roller cone drill bits associated with conventional drill strings.

For purposes of describing various features of the present invention, cone assemblies 30 may be identified as 30*a*, 30*b* and 30*c*. Cone assemblies 330 may be identified as 330*a*, 330*b* and 330*c*. Cone assemblies 30 and 330 may sometimes be referred to as "rotary cone cutters", "roller cone cutters" or "cutter cone assemblies". Cone assemblies associated with roller cone drill bits generally point inwards towards each other. Rows of cutting elements and cutting structures extend or protrude from the exterior of each cone assembly.

Roller cone drill bit 20, shown in FIG. 1, preferably includes bit body 24 having tapered, externally threaded portion 22 adapted to be secured to one end of a drill string. Bit body 24 preferably includes a passageway (not expressly shown) to communicate drilling mud or other fluids from the well surface through the drill string to attached drill bit 20. Drilling mud and other fluids may exit from nozzles 26. Formation cuttings and other debris may be carried from the bottom of a borehole by drilling fluid ejected from nozzles 26. Drilling fluid generally flows radially outward between the underside of roller cone drill bit 20 and the bottom of an associated wellbore. The drilling fluid may then flow generally upward to the well surface through an annulus (not expressly shown) defined in part by the exterior of roller cone drill bit 20 and an associated drill string and the inside diameter of the wellbore.

For embodiments of the present invention represented by drill bit 20, bit body 24 may have three (3) support arms 32 extending therefrom. The lower portion of each support arm 32 opposite from bit body 24 preferably includes a respective spindle or shaft 34. See FIG. 3. Spindle 34 may also be referred to as a "journal" or "bearing pin". Each cone assembly 30*a*, 30*b* and 30*c* preferably includes respective cavity 48 extending from backface 146. The dimensions and configuration of each cavity 48 are preferably selected to receive an associated spindle 34.

Cone assemblies 30*a*, 30*b* and 30*c* may be rotatably attached to respective spindles 34 extending from support arms 32. Cone assembly 30*a*, 30*b* and 30*c* include respective axis of rotation 36 (sometimes referred to as "cone rotational axis"). The axis of rotation of a cone assembly often corresponds with the longitudinal center line of an associated spindle. Cutting or drilling action associated with drill bit 20 occurs as cutter cone assemblies 30*a*, 30*b* and 30*c* roll around the bottom of a wellbore. The diameter of the resulting wellbore corresponds approximately with the combined outside diameter or gauge diameter associated with gauge face 42 cutter cone assemblies 30*a*, 30*b* and 30*c*.

A plurality of compacts 40 may be disposed in gauge face 42 of each cone assemblies 30*a*, 30*b* and 30*c*. Compacts 40 may be used to "trim" the inside diameter of a wellbore to prevent other portions of gauge face 42 and/or backface 146 from contacting the adjacent formation. A plurality of cutting elements 60 may also be disposed on the exterior of each cone assembly 30*a*, 30*b* and 30*c* in accordance with teachings of the present invention.

Compacts 40 and cutting elements 60 may be formed from a wide variety of hard materials such as tungsten carbide. The term "tungsten carbide" includes monotungsten carbide (WC), ditungsten carbide ($W_2C$), macrocrystalline tungsten carbide and cemented or sintered tungsten carbide. Examples of hard materials which may be satisfactorily used to form compacts 40 and cutting elements 60 include various metal alloys and cermets such as metal borides, metal carbides, metal oxides and metal nitrides.

Rotational axes 36 of cone assemblies 30*a*, 30*b* and 30*c* are preferably offset from each other and rotational axis 38 associated with roller cone bit 20. Axis 38 may sometimes be referred to as "bit rotational axis". The weight of an associated drill string (sometimes referred to as "weight on bit") will generally be applied to drill bit 20 along bit rotational axis 38. For some applications, the weight on bit acting along bit rotational axis 38 may be described as the "downforce". However, many wells are often drilled at an angle other than vertical. Wells are frequently drilled with horizontal portions (sometimes referred to as "horizontal wellbores"). The forces applied to drill bit 20 by a drill string and/or a downhole drilling motor will generally act upon drill bit 20 along bit rotational axis 38 without regard to vertical or horizontal orientation of an associated wellbore. The forces acting on drill bit 20 and each cutting element 60 are also dependent on the type of downhole formation being drilled. Forces acting on each cutting element 60 may vary substantially as drill bit 20 penetrates different formations associated with a wellbore.

Figure 2:
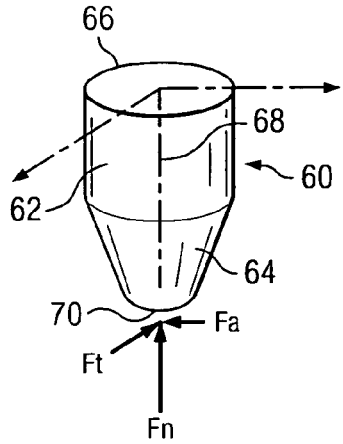
FIG. 2 is a schematic drawing showing one example of a cutting element and forces exerted on the cutting element during impact with a formation.

The cone offset and generally curved cone profile associated with cone assemblies 30*a*, 30*b* and 30*c* result in cutting elements 60 impacting a formation with a crushing or penetrating motion and a scraping or shearing motion. FIG. 2 is a schematic drawing showing three forces which act on cutting element 60 during impact with a formation and cutting of materials from the formation. The forces include a normal force $F_n$, a radial force $F_a$ and a tangent force $F_t$.

The normal force $F_n$ typically results directly from the weight placed on a roller cone drill bit by an associated drill string and/or forces applied by a downhole drill motor. Associated weight on bit and/or drill motor forces are primarily responsible for each cutting element 60 penetrating or crushing the formation. Radial force $F_a$ and tangent force $F_t$ depend upon the magnitude of scraping or shearing motion associated with each cutting element 60. The amount of shearing or scraping depends upon various factors such as orientation of each cutting element, offset of an associated cone assembly and associated cone assembly profile. The design, configuration and size of each cutting element also determines the value of radial force $F_a$ and tangent force $F_t$. For many downhole drilling applications normal force $F_n$ is usually much larger in magnitude than either radial force $F_a$ or tangent force $F_t$.

Various types of computer simulations may be satisfactorily used to determine when each cutting element 60 impacts an adjacent formation during drilling with drill bit 22. The combined forces or loads placed on each cone assembly 30*a*, 30*b* and 30*c* may be summarized as the net result of all forces acting on compacts 40 and cutting elements 60 of the respective cone assembly. Each cone assembly 30*a*, 30*b* and 30*c* may be considered as a rigid body which allows simplification of cone forces into three orthogonal linear forces and three orthogonal moments as shown in FIG. 1.

Orthogonal linear forces ($F_x$, $F_y$, $F_z$) and orthogonal moments ($M_x$, $M_y$, $M_z$) may be analyzed using a cone coordinate system defined in part by the Z axis which extends along the associated cone rotational axis. For drill bit 20 the X axis and the Y axis preferably intersect with each other and the Z axis proximate the intersection of cone rotational axis 36 and the exterior surface of associated support arm 32. The Z axis corresponds with cone rotational axis 36. See FIG. 1.

Moment $M_z$ measured relative to cone rotational axis 36 generally corresponds with torque on an associated cone assembly 30. Moment $M_z$ is normally balanced by rotation of the associated cone assembly 30. Moments $M_x$ and $M_y$ often cause each cone assembly 30 to wobble relative to associated spindle 34. The bearing system associated with each cone assembly 30 must balance or absorb the moments $M_x$ and $M_y$. For most rotary cone drill bits, normal force $F_n$ is often the most significant contributor to moments $M_x$ and $M_y$.

Cutting element 60 as shown in FIG. 2 may include generally cylindrical body 62 with extension 64 extending therefrom. Base portion 66 of cylindrical body 62 may be designed to fit within corresponding sockets or openings 58 in cone assemblies 30*a*, 30*b* and 30*c*. For some applications cylindrical body 62 and extension 64 may be formed as integral components. Extension 64 may have various configurations which include a crest and a crest point. Various types of press fitting techniques may be satisfactorily used to securely engage each cutting element 60 with respective sockets or opening 58. For some applications cutting elements 60 may be generally described as inserts.

As shown in FIG. 2, three forces generally act on a cutting element during the process of removing formation material from the bottom of a wellbore—normal force $F_n$, radial force $F_a$ and tangent force $F_t$. Forces $F_t$, $F_n$ and $F_a$ may be assumed to act on cutting element 60 at crest point 70. Crest point 70 corresponds generally with the center of an associated cutting zone for cutting element 60. The resulting forces may be transmitted from cylindrical body 62 to adjacent portions of cone assembly 30.

Normal force $F_n$ generally results from the total force applied to drill bit 20 along bit rotational axis 38. The value of normal force $F_n$ depends upon factors such as the angle of associated cone rotational axis 36, offset of the associated cone assembly relative to bit rotational axis 38 and associated cone profile. As previously noted normal force $F_n$ is typically much larger than other forces acting upon cutting element 60.

Normal force $F_n$ will generally act along a normal force vector extending from the center of an associated cutting zone. For some applications the normal force vector may correspond approximately with the longitudinal axis or geometric axis of an associated cutting element. For other applications normal force axis 68 may be offset from the geometric axis depending upon the configuration and orientation of each cutting element relative to an associated cone rotational axis. For embodiments represented by cutting element 60, normal force $F_n$ may act along normal force axis 68.

Figure 3:
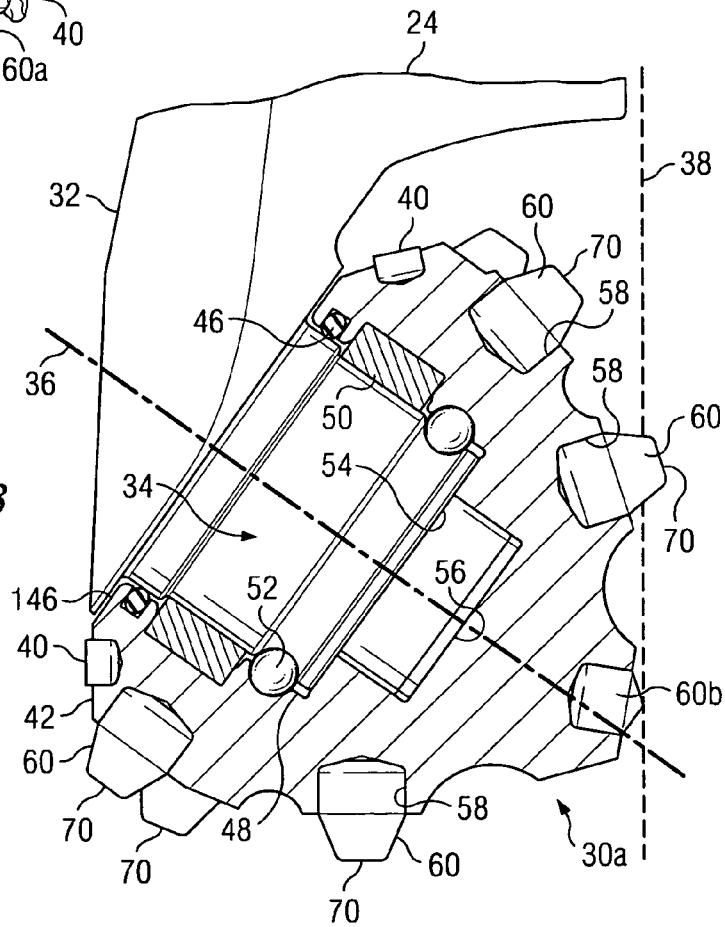
FIG. 3 is a schematic drawing in section and in elevation with portions broken away showing one example of a cone assembly rotatably mounted on a support arm.

FIG. 3 shows portions of support arm 34 with cone assembly 30*a* rotatably mounted on spindle 34. Cone assembly 30*a* may rotate about cone rotational axis 36 which tilts downwardly and inwardly at an angle relative to bit rotational axis 38. Seal 46 may be disposed between the exterior of spindle 34 and the interior of cylindrical cavity 48. Seal 46 forms a fluid barrier between exterior portions of spindle 34 and interior portions of cavity 48 to retain lubricants within cavity 48 and bearings 50 and 52. Seal 46 also prevents infiltration of formation cuttings into cavity 48. Seal 46 protects bearings 50 and 52 from loss of lubricant and from contamination with debris and thus prolongs the downhole life of drill bit 20.

Bearings 50 support radial loads associated with rotation of cone assembly 30*a* relative to spindle 34. Bearings 54 support thrust loads associated with limited longitudinal movement of cone assembly 30 relative to spindle 34. Bearings 50 may sometimes be referred to as journal bearings. Bearings 54 may sometimes be referred to as thrust bearings. Bearings 52 may be used to rotatably engage cone assembly 30*a* with spindle 34.

Various features of the present invention will be described with respect to cutting elements 60, 60*a* and 60*b* used with conventional roller cone drill bits and the same cutting elements 60, 60*a* and 60*b* used with roller cone drill bits formed in accordance with teachings of the present invention. Cone assemblies shown in FIGS. 4A-7 may have substantially the same cavity 48, gauge face 42 and backface 146. Compacts 40 are not shown in sockets 44 of gauge face 42. Each cone assembly is shown with gauge row 74 having cutting element 60*a*. The other rows of cutting elements associated with the cone assemblies include cutting elements 60 and 60*b*. Cutting elements 60*a* and 60*b* may have smaller dimensions than cutting elements 60.

For some applications the dimensions of all cutting elements associated within a cone assembly and roller cone drill bit incorporating teachings of the present invention may have substantially the same dimensions and configurations. Alternatively, some cone assemblies and associated roller cone bits may include cutting elements and cutting structures with substantial variation in both configuration and dimensions of associated cutting elements and cutting structures. The present invention is not limited to roller cone drill bits having cutting elements 60, 60*a* and 60*b*. Also, the present invention is not limited to cone assemblies and roller cone drill bits having cavity 48 and gauge face 42.

FIG. 4A is a schematic drawing in section with portions broken away showing one example of a cone profile associated with a conventional cone assembly. FIG. 4B is a schematic drawing showing a composite cone profile for a conventional roller cone drill bit having three cone assemblies with multiple cutting elements disposed on each cone assembly. Cone assembly 130 as shown in FIG. 4A is generally representative of the three cone assemblies associated with composite cone profile 180 shown in FIG. 4B. The number of cutting elements, the number of rows of cutting elements, and the location of cutting elements on each conventional cone assembly will generally vary from one cone assembly to the next.

For conventional cone assembly 130 shown in FIG. 4A, cutting elements 60*a* may be disposed in gauge row 74. For this example, cutting elements 60*a* may also be smaller in size as compared with cutting elements 60. Normal force axes 68*a* associated with cutting elements 60*a* in gauge row 74 extend at an angle substantially perpendicular to associated cone rotational axis 36. Cone profile 180 associated with cone assembly 130 has a generally curved, but is not circular, shape. Crest points 68 of cutting elements 60 are not located on a circle. Normal force axes 68 of respective cutting elements 60 intersect at multiple locations relative to each other and cone rotational axis 36.

FIG. 4B is a schematic drawing showing a composite cone profile for a conventional roller cone drill bit having three (3) assemblies with multiple cutting elements arranged in rows on each cone assembly. The crests of all cutting elements are shown projected onto a vertical plane passing through composite rotational axis 36 of the associated cone assemblies. Normal force axes 68 do not intersect or pass through a single point.

FIG. 5A is a schematic drawing showing composite cone profile 80 for cone assemblies 30*a*, 30*b* and 30*c* having cutting elements 60, 60*a* and 60*b* disposed thereon in accordance with teachings of the present invention. Crest points 70 do not define a circle. Some of the crest points 70 extend outside circle 82 and other crest points 70 are located within circle 82. All normal force axes 68 associated with cutting elements 60 and 60*b* preferably intersect at force center 90 located on cone rotational axis 36. Normal force axes 68*a* associated with cutting elements 60*a* of gauge row 74 are offset from and do not intersect with force center 90*a* associated with normal force axes 68. As shown in this embodiment, normal force axis 68*a* is generally perpendicular to cone rotational axis 36. For this embodiment force center 90 may be relatively small with dimension corresponding to a small sphere. The intersection of normal force axes 68 at a relatively small force center or single point on cone rotational axis 36 substantially reduces or eliminates moments $M_x$ and moments $M_y$ which may significantly reduce wobble of associated cone assemblies 30*a*, 30*b* and 30*c* relative to respective spindles 34. Reducing cone wobble may increase the life of associated bearings and seals.

In some embodiments, normal force axes 68 may intersect force center 90, where force center 90 is located proximate a center of an associated bearing system (including bearings 50 and 52 as shown in FIG. 3) of cone assembly 30*a*. In alternate embodiments that include only a single bearing, normal force axes 68 may preferably intersect force center 90 where force center 90 generally corresponds with an associated bearing support center. For embodiments with additional bearing components within an associated bearing system, normal force axes 68 may intersect at a force center that generally corresponds with a composite support center for all components of the bearing system.

Figure 5D:
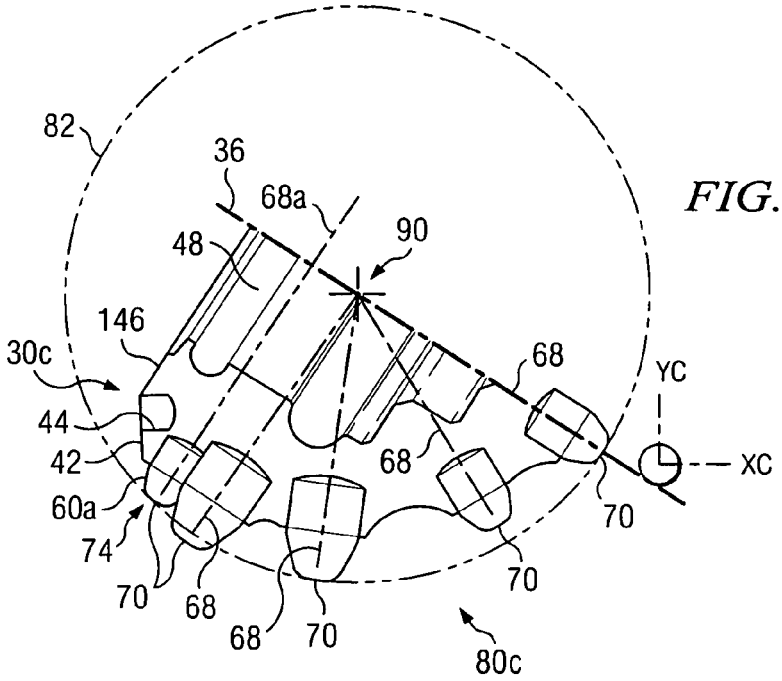
FIG. 5D is a schematic drawing showing a cone profile for a third cone assembly associated with the composite cone profile of FIG. 5A.

FIGS. 5B, 5C and 5D show respective cone profiles 80*a*, 80*b* and 80*c* associated with cone assemblies 30*a*, 30*b* and 30*c*. Cutting elements 60 and 60*b* are preferably disposed on respective cone assemblies 30*a*, 30*b* and 30*c* such that normal force axes 68 intersect at respective force centers 90*a*, 90*b* and 90*c* on respective cone rotational axes 36.

Figure 6A:
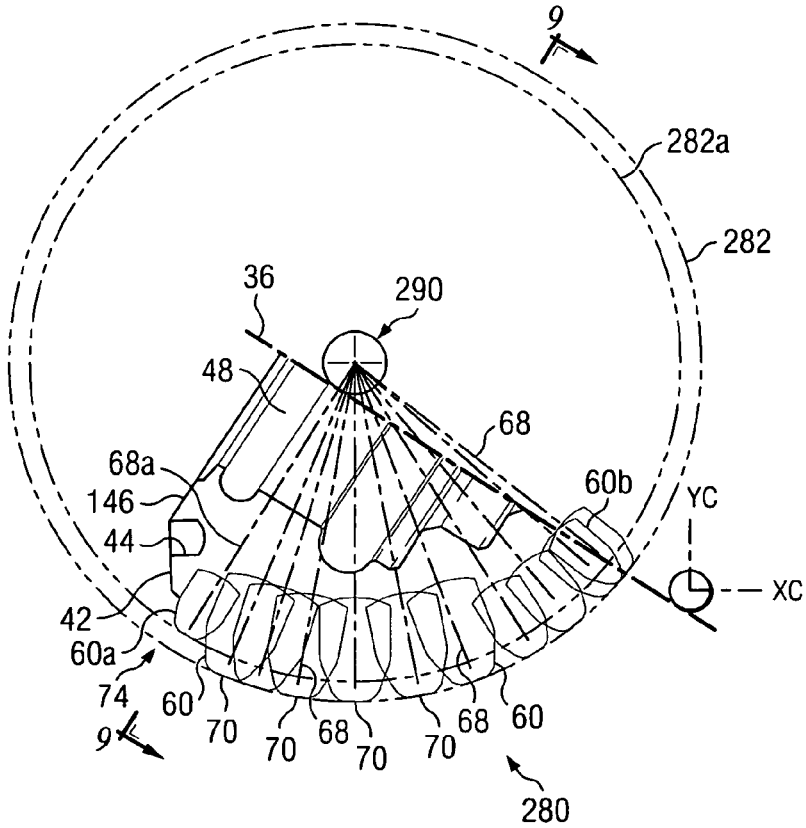
FIG. 6A is a schematic drawing showing a composite cone profile associated with a roller cone drill bit having three cone assemblies with cutting elements and cutting structures incorporating teachings of the present invention.

FIG. 6A is a schematic drawing showing composite cone profile 280 for cone assemblies 230*a*, 230*b* and 230*c* having cutting elements 60, 60*a* and 60*b* disposed thereon in accordance with teachings of the present invention. For this embodiment normal force axes 68*a* associated with cutting elements 60*a* of gauge rows 74 and normal force axes 68 associated with cutting elements 60 and 60*b* preferably intersect with each other at force center 290. For this embodiment force center 290 may be offset from composite cone rotational axis 36. The amount of offset measured by $d_x$ and $d_y$ is preferably limited to the smallest amount possible. See FIG. 9. Limiting the value of $d_x$ and $d_y$ to a small value will substantially reduce moment forces $M_x$ and $M_y$ placed on associated cone assemblies 230*a*, 230*b* and 230*c*. For some applications force center 290 may have dimensions of a very small sphere. The radius of force center 290 may be equal to or less than the distance between the center of force center 290 and cone rotational axis 36 to further minimize forces and moments associated with cone wobble.

Crest points 70 associated with cutting elements 60 and 60*b* are preferably disposed on circle 282. The radius of circle 282 corresponds with the length of normal force axes 68 between associated crest points 70 and force center 290. The length of normal force axis 68*a* may be less than normal force axes 68 which results in circle 282*a*. Placing crest points 70 of cutting elements 60 and 60*b* on the same circle 282 may substantially improve drilling stability and directional control of the associated roller cone drill bit.

Figure 6B:
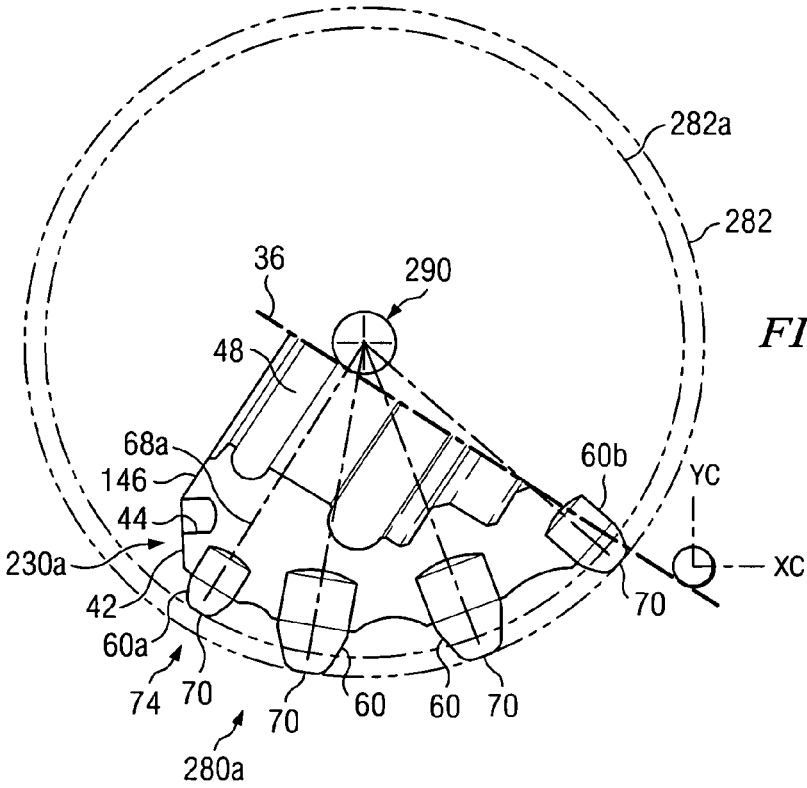
FIG. 6B is a schematic drawing showing a cone profile for a first cone assembly associated with the composite cone profile of FIG. 6A.
Figure 6C:
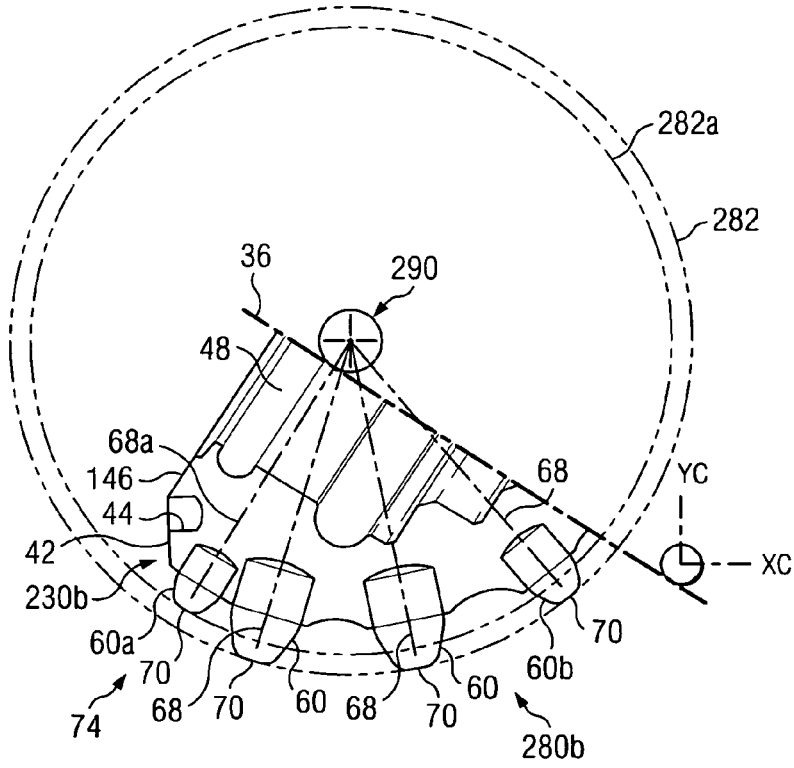
FIG. 6C is a schematic drawing showing a cone profile for a second cone assembly associated with the composite cone profile of FIG. 6A.
Figure 6D:
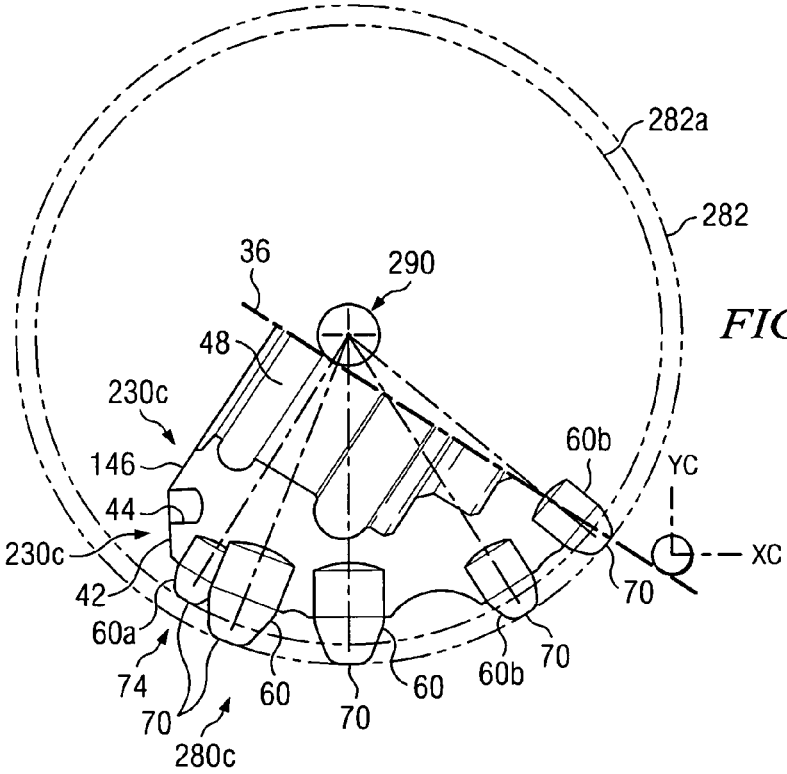
FIG. 6D is a schematic drawing showing a cone profile for a third cone assembly associated with the composite cone profile of FIG. 6A.

FIGS. 6B, 6C and 6D show respective cone profiles 280*a*, 280*b* and 280*c* associated with cone assemblies 230*a*, 230*b* and 230*c* such that normal force axes 68 and 68*a* intersect at respective force centers 290*a*, 290*b* and 290*c* offset or skewed from respective cone rotational axes 36. Crest points 70 of cutting element 60 and 60*b* are preferably disposed on circle 282. Crest points 70 of cutting elements 60*a* in associated gauge rows 74 are preferably disposed on circle 282*a*.

Figure 7:
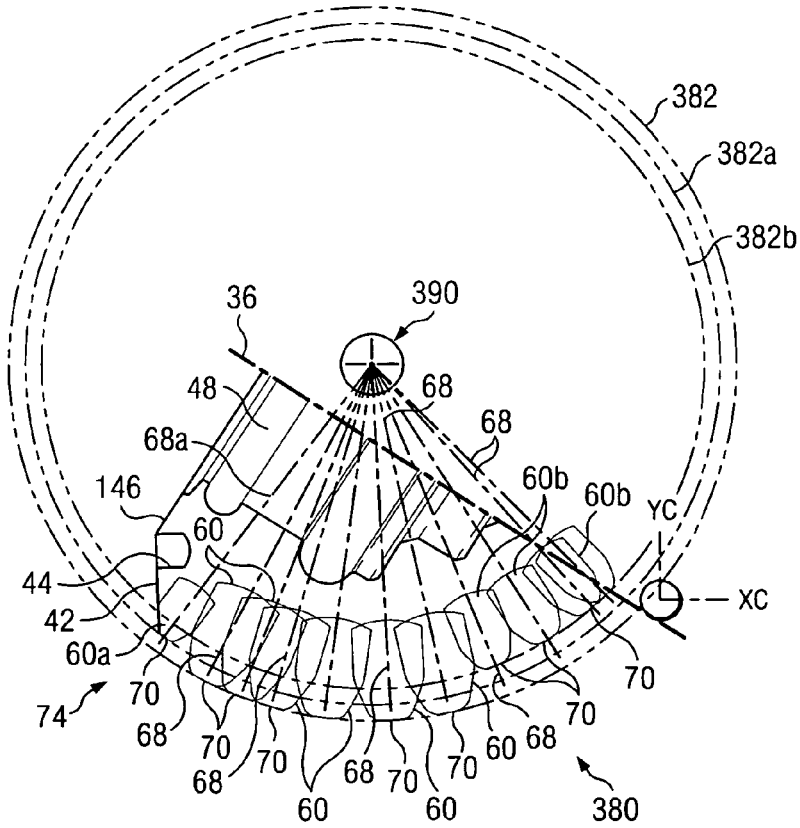
FIG. 7 is a schematic drawing showing a composite cone profile for a roller cone drill bit having three cone assemblies with cutting elements and cutting structures incorporating teachings of the present invention.

FIG. 7 is a schematic drawing showing composite cone profile 380 associated with three cone assemblies (not expressly shown) having cutting elements 60, 60*a* and 60*b* disposed thereon in accordance with teachings of the present invention. For this embodiment, normal force axes 68*a* associated with cutting elements 60*a* of each gauge row 74 and normal force axes 68 associated with cutting elements 60*a* and 60*b* preferably intersect with each other at normal force center 390. For this embodiment force center 390 may be offset or skewed from composite cone rotational axis 36. For some applications, the offset of force enter 390 from cone rotational axis 36 is preferably minimized to reduce forces and moments that may induce cone wobble.

Crest points 70 of cutting elements 60 and 60*b* may be disposed on respective circles 382 and 382*b*. Crest points 70 associated with cutting element 60*a* of gauge rows 74 may be disposed on circle 382*a*. Circles 382, 382*a* and 382*b* are preferably disposed concentric with each other relative to force center 390.

FIG. 8 is a schematic drawing showing various steps associated with one method to design a roller cone drill bit with cutting elements and cutting structures incorporating teachings of the present invention. The method begins 100 by first inputting bit size, bit type (such as identified by Independent Association of Drilling Contractors (IADC) codes), pin angle, cone offset, backface diameter and cone oversize angle at step 102. The locations of the cone axis and cone backface are determined within the bit coordinate system at step 104.

The location of an associated force center is determined in the cone and bit coordinate systems at step 106. In some embodiments, the location of the force center may correspond to the rotational axis of the cone as well as the center of the bearing or bearing assembly associated with each cone.

Respective lines are drawn from the force center at step 108. The location of cutting elements on the gauge row of each cone are determined within the cone coordinate system. The normal force vector of the gauge row cutting elements are aligned in a specified direction at step 110.

The number of inner row cutting elements are determined for each cone at step 112. The location of each inner row of cutting elements is determined for each cone in the cone coordinate system, preferably including the profile angle at step 114.

The bit design is checked to insure that all cutting element axes pass through the force center of each cone at step 116. The rows of the cutting elements for each cone are then distributed to provide desired over lap with cutting elements in adjacent cones.

The cutting element profiles for all rows on all cones are then checked to avoid interference at step 120. If interference exists, the location of one or more rows may be adjusted to remove any interference at step 122. The number of cutting elements that are going to be include on each row is determined and the skew angle of each cutting element is determined 124.

The final bit design is compared to a selected design criteria to determine whether all the design criteria have been met at step 126. If design criteria have been met the method ends. If all design criteria have not been met the method returns to step 106 and a revised force center is determined in the cone and bit coordinate systems 106. Further steps are repeated until the design criteria of the bit have been met at step 126.

Design criteria for a roller cone drill bit may be based in part on anticipated downhole formations, desired diameter and depth of a wellbore formed by the drill bit, desired rate of penetration, weight on bit and other criteria normally associated with design of roller cone drill bits. The present invention allows designing drill bits with increased probability that each drill bit when manufactured will meet the selected or desired design criteria. The present invention may substantially reduce or eliminate extensive field testing of prototype drill bits to confirm performance characteristics of a new drill bit design.

Figure 9:
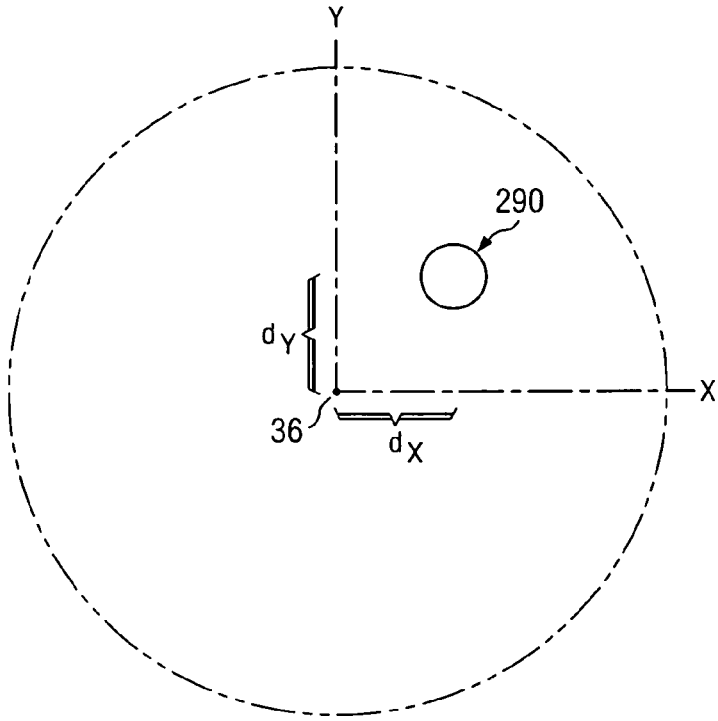
FIG. 9 is a graphical representation of an offset which may occur between a normal force center and rotational axis of a cone assembly with cutting elements and cutting structures incorporating teachings of the present invention.

FIG. 9 is a graphical representation of the offset or skew angle of force center 290 relative to cone rotational axis 36. As shown, force center 290 is offset from cone rotation axis 36 by distances $d_x$ and $d_y$. The effects of distances $d_x$ and $d_y$ may be minimized by reducing force center 290 to a relatively small sphere or point. Also, design of associated cone profiles may be revised to reduce the value of $d_x$ and $d_y$. For example, the associated cone profiles may be redesigned such that the value of $d_x$ and $d_y$ is less than the radius of force center 290. The present invention allows reducing forces and movements placed on associated cone assemblies to reduce cone wobble. For some embodiments an offset along the Z axis ($d_z$) may also be analyzed. The Z axis corresponds generally along with cone rotation axis 36.

FIG. 10 is a schematic drawing showing roller cone drill bit 320 having bit body 324 with tapered, externally threaded portion 32. Bit body 324 preferably includes a passageway (not expressly shown) to communicate drilling mud or other fluids from the well surface through a drill string to attached drill bit 320. Bit body 324 may have substantially identical support arm 322 extending therefrom. Each support arm preferably includes a respective shaft or spindle (not expressly shown). Cone assemblies 330*a*, 330*b* and 330*c* may be attached to respective spindles.

Cutting elements 360 with respective crests 368 and crest points 370 may be formed on each cone assembly 330*a*, 330*b* and 330*c* using milling techniques. Cutting elements 360 may sometimes be referred to as "milled teeth". Cutting elements 360 may have normal force axes intersecting with associated force centers as previously described with respect to roller cone drill bit 20.

Although the present invention and its advantages have been described in detail, it should be understood that various changes, substitutions and alternations can be made herein without departing from the spirit and scope of the invention as defined by the following claims.

What is claimed is:

1. A roller cone drill bit comprising:

a bit body having at least one support arm extending therefrom;

a cone assembly rotatably mounted on the at least one support arm for engagement with a subterranean formation to form a wellbore;

the cone assembly having a respective axis of rotation extending from the associated support arm;

the cone assembly having a backface disposed adjacent the at least one support arm;

the cone assembly having a plurality of cutting elements;

every cutting element on the cone assembly being either a gauge cutting element or a non-gauge cutting element, the gauge elements arranged in a gauge row located adjacent the backface of the cone assembly;

each cutting element having a crest extending from the associated cone assembly for engagement with the formation;

each crest having a respective crest point defined as a point located a greater distance from the axis of rotation of the associated cone assembly as compared with the distance between any other point on the crest and the axis of rotation of the associated cone assembly;

each cutting element having a normal force axis extending from the cone assembly through the respective crest point; and every non-gauge cutting element on the cone assembly configured such that the normal force axis of every non-gauge cutting element intersects with each other proximate a force center selected to minimize the wobble effects on the cone assembly due to normal forces from the cutting elements impacting the formation as the cone assembly rotates.

2. The drill bit of claim 1 further comprising the force center located proximate the axis of rotation of the cone.

3. The drill bit of claim 1 further comprising the force center disposed on the axis of rotation of the cone.

4. The drill bit of claim 1 further comprising the force center having a generally spherical configuration.

5. The drill bit of claim 4 further comprising the force center having a radius less than the distance between the force center and the cone rotational axis.

6. The drill bit of claim 1 further comprising:

each cutting element having a respective cutting zone with a respective crest point located proximate the center of the respective cutting zone; and at least two rows of cutting elements on the cone assembly having the respective crest points located at approximately the same radial distance from the force center.

7. The drill bit of claim 6 further comprising at least three rows of cutting elements on the cone assembly having the respective crest points located at approximately the same radial distance from the force center.

8. The drill bit of claim 1 further comprising:

three support arms extending from the bit body;

a respective cone assembly rotatably mounted on each support arm for engagement with the formation;

each cone assembly having a respective rotational axis;

each crest having a respective crest point defined as a point on each cutting element located at a greater distance from the rotational axis of the cone assembly as compared with the distance between other points on the respective crest and the rotational axis of the cone;

each cone assembly having a respective cone profile defined in part as the crest point of all cutting inserts projected onto a vertical plane passing through the rotational axis of the cone assembly; and the composite profile of the crest points for each cone assembly cooperating with each other to define a segment of a circle having a radius extending from the associated rotational axis of the cone.

9. The drill bit of claim 1 wherein the cutting elements comprise inserts attached to respective cone assemblies.

10. The drill bit of claim 1 wherein each cutting element comprises a milled tooth.

11. A roller cone drill bit comprising:

a bit body having at least one support arm extending therefrom;

a cone assembly rotatably mounted on the at least one support arm for engagement with a subterranean formation to form a wellbore;

the cone assembly having a gauge row of cutting elements;

the cone assembly having four or more rows of cutting elements spaced from the gauge row;

the four or more rows of cutting elements spaced from each other;

each cutting element having a crest extending from the associated cone assembly for engagement with adjacent portions of the formation;

the cone assembly having an axis of rotation extending from the respective support arm;

each cutting element having a normal force axis extending from the respective crest;

each cutting element having a respective cutting element profile angle defined in part by an intersection of the respective normal force axis and the axis of rotation of the associated cone assembly; and the cutting element profile angles associated with each cutting element in the four or more rows of cutting elements selected so that the normal force axes of each cutting element intersect at a common force center.

12. The drill bit of claim 11 wherein the force center comprises a location on the axis of rotation of the cone assembly.

13. The drill bit of claim 11 wherein the force center comprises very small dimensions approaching a single point.

14. The drill bit of claim 11 further comprising:

three support arms extending from the bit body; and a respective cone assembly rotatably mounted on each support arm for engagement with the formation.

15. The drill bit of claim 11 further comprising the location of the force center selected relative to the axis of rotation of the associated cone assembly to minimize cone wobble when associated cutting elements impact the formation.

16. The drill bit of claim 11 wherein the cutting elements comprise inserts and compacts.

17. The drill bit of claim 11 wherein each cutting element comprises a milled tooth.

18. The drill bit of claim 11 further comprising the respective crest points of the first row of cutting elements and the second row of cutting elements located at approximately the same radial distance from the force center.

19. The drill bit of claim 11 further comprising the cutting element profile angle for each cutting element in the gauge row selected so that the respective normal force axes extends generally normal to the axis of rotation of the associated cone assembly.

20. The drill bit of claim 11 further comprising the cutting element profile angle of each cutting element in the gauge row selected so that the normal force axes pass through the force center.

21. A method for forming a roller cone drill bit with enhanced drilling ability comprising:

forming a bit body with at least one support arm extending therefrom;

rotatably mounting a cone assembly on the at least one support arm, the cone assembly having a backface disposed adjacent the at least one support arm;

forming a plurality of cutting elements on the cone assembly with each cutting element having a crest extending from the cone assembly for engagement with the formation, and with every cutting element on the cone assembly being either a gauge cutting element or a non-gauge cutting element, the gauge cutting elements arranged in a gauge row located adjacent the backface of the cone assembly;

selecting a location and orientation for each non-gauge cutting element with its respective normal force axis intersecting at a single force center; and selecting the location of the single force center to reduce wobble of the cone assembly and provide improved drilling stability of the drill bit.

22. The method of claim 21 further comprising reducing the dimension of the force center to correspond approximately with a single point of intersection for the normal force axes.

23. The method of claim 21 further comprising:

forming the bit body with three support arms extending therefrom; and rotatably mounting respective cone assemblies on the support arms.

24. The method of claim 21 further comprising selecting the location of the force center to minimize wobble effects of normal forces associated with the cutting elements impacting a formation as the drill bit rotates.

25. A roller cone drill bit operable to form a wellbore in a subterranean formation comprising:

a bit body having at least one support arm extending therefrom;

a cone assembly rotatably mounted on the at least one support arm;

the cone assembly having a respective axis of rotation extending from the at least one support arm;

the cone assembly having a plurality of cutting elements;

each cutting element having a crest extending from the associated cone assembly for engagement with the formation;

each crest having a respective crest point defined as a point located a greater distance from the axis of rotation of the cone assembly as compared with the distance between any other point on the crest and the axis of rotation of the cone assembly;

each cutting element having a normal force axis extending from the cone assembly through the respective crest point;

the cone assembly having a respective cone assembly profile defined in part as a combined projection of the crests of all cutting elements onto a plane passing through the axis of rotation of the cone assembly; and the normal force axes of every one of the plurality of cutting elements intersecting with each other proximate a force center.

26. The drill bit of claim 25 further comprising the force center located proximate the axis of rotation of the cone assembly to minimize the effect on the cone assembly of normal forces from the cutting elements impacting the formation as the cone assembly rotates.

27. The drill bit of claim 25 further comprising the force center disposed on the axis of rotation of the cone assembly.

28. The drill bit of claim 25 further comprising the force center having a generally spherical configuration.

29. The drill bit of claim 28 further comprising the force center having a radius less than the distance between the force center and the cone rotational axis.

30. A roller cone drill bit operable to form a wellbore in a subterranean formation comprising:

a bit body having at least one support arm extending therefrom;

a cone assembly rotatably mounted on the at least one support arm;

the cone assembly having a respective axis of rotation extending from the at least one support arm;

the cone assembly having a plurality of cutting elements;

each cutting element having a crest extending from the cone assembly for engagement with the formation;

each crest having a respective crest point defined as a point located a greater distance from the axis of rotation of the cone assembly as compared with the distance between any other point on the crest and the axis of rotation of the cone assembly;

each cutting element having a normal force axis extending from the cone assembly through the respective crest point;

the cone assembly having a respective cone assembly profile defined in part as a combined projection of the crests of all cutting elements onto a plane passing through the axis of rotation of the cone assembly;

the normal force axes of each one of the plurality of cutting elements intersecting with each other proximate a force center;

each cutting element having a respective cutting zone with the respective crest point located proximate the center of the respective cutting zone; and at least one row of cutting elements on the cone assembly having the respective crest points located at approximately the same radial distance from the force center.

31. The drill bit of claim 30 further comprising at least two rows of cutting elements on the cone assembly having respective crest points located at approximately the same radial distance from the force center.

32. The drill bit of claim 30 further comprising at least three rows of cutting elements on the cone assembly having the respective crest points located at approximately the same radial distance from the force center.

33. The drill bit of claim 30 further comprising:

three support arms extending from the bit body;

a respective cone assembly rotatably mounted on each support arm for engagement with the formation;

each cone assembly having a respective rotational axis;

each crest having a respective crest point defined as a point on each cutting element located at a greater distance from the rotational axis of the cone assembly as compared with the distance between other points on the respective crest and the rotational axis of the cone;

each cone assembly having a respective cone profile defined in part as the crest point of all cutting inserts projected onto a vertical plane passing through the rotational axis of the cone assembly; and the composite profile of the crest points for each cone assembly cooperating with each other to define a segment of a circle having a radius extending from the associated rotational axis of the cone.

* * * * *